US006980171B2

(12) United States Patent
Maruyama et al.

(10) Patent No.: US 6,980,171 B2
(45) Date of Patent: Dec. 27, 2005

(54) ANTENNA AND MANUFACTURING METHOD FOR THE SAME

(75) Inventors: Kota Maruyama, Toyoake (JP); Wataru Yagi, Nagoya (JP); Makoto Tsukahara, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 17 days.

(21) Appl. No.: 10/395,282

(22) Filed: Mar. 25, 2003

(65) Prior Publication Data

US 2003/0184489 A1 Oct. 2, 2003

(30) Foreign Application Priority Data

Mar. 26, 2002 (JP) ..... 2002-085947

(51) Int. Cl.[7] ..... H01Q 7/08; H01Q 1/00
(52) U.S. Cl. ..... 343/788; 343/787
(58) Field of Search ..... 343/866, 895, 343/713, 788, 787; 336/178, 184, 177, 221, 234

(56) References Cited

U.S. PATENT DOCUMENTS 5,396,698 A 3/1995 Orthmann et al.
5,567,537 A * 10/1996 Yoshizawa et al. ..... 428/692
5,625,366 A 4/1997 D'Hont
5,867,100 A * 2/1999 D'Hont ..... 340/572.1
6,583,764 B2 * 6/2003 Ieda et al. ..... 343/742
6,603,441 B2 * 8/2003 Teshima ..... 343/895
6,664,936 B2 * 12/2003 Ieda et al. ..... 343/866
2002/0033777 A1 3/2002 Maruyama et al.
2002/0163474 A1 * 11/2002 Ieda et al. ..... 343/742

FOREIGN PATENT DOCUMENTS

DE 41 09 840 A1 10/1992
EP 0 762 535 A1 3/1997
JP 5-267922 A 10/1993
JP 7-221533 A 8/1995

* cited by examiner

*Primary Examiner*—Don Wong
*Assistant Examiner*—Minh Dieu A

(74) *Attorney, Agent, or Firm*—Burns, Doane, Swecker & Mathis LLP

(57) ABSTRACT

An antenna is comprised of a core portion laminated by a magnetic ribbon through a deformable member and a coil portion wound around the core portion.

20 Claims, 4 Drawing Sheets

ANTENNA AND MANUFACTURING METHOD FOR THE SAME

CROSS REFERENCE OF RELATED APPLICATION

This application is based on and claims priority under 35 U.S.C. § 119 with respect to Japanese Application No. 2002-085947 filed on Mar. 26, 2002, the entire content of which is incorporated herein by reference.

FIELD OF THE INVENTION

This invention relates to an antenna and a manufacturing method for the same. More particularly, the present invention pertains to an antenna installed at an opening and closing portion of a vehicle or a house.

BACKGROUND OF THE INVENTION

In recent years, there has been a development of an electric key system which does not have a key cylinder at an opening and closing portion of a vehicle or a house. The electric key system functions that when a person with an electric key approaches to the opening and closing portion, the system becomes a reception standby mode, and when it receives an ID code from the electric key, the system unlocks as soon as the person touches a door handle etc.

In this type of the electric key system, it is desired to install an antenna within the opening and closing portion or control portion for opening and closing (inside of a door or a door handle If the opening and closing portion corresponds to the door). Generally, since there Is not much space to install in such places, a bar antenna whose core is made of a material with high permeability is applied.

A known device is disclosed in Japanese Patent Laid-Open Publication No. 5-267922. In the known device, an antenna for a vehicle whose core is made of a laminate of amorphous magnetic alloy ribbons is applied to improve high frequency characteristic and to achieve downsizing.

Another known device is disclosed in Japanese Patent Laid-Open Publication No. 7-221533. In this known device, an antenna applying a laminate of nanocrystalline magnetic alloy ribbons for a material of the core is disclosed, and the antenna is achieved in obtaining a sufficient level of signals, feasibility to downsize, and a stability against a temperature characteristic or time deterioration.

However, in the opening and closing portion, a bending load is applied to the antenna upon opening and closing the door due to vibration. In addition, Impact upon opening and closing the door is large. Therefore, the known devices could be damaged due to these loads. Particularly, in a case of a vehicle door (an opening and closing portion), it receives Impact from both front and back directions of the vehicle upon acceleration and deceleration. Moreover, larger impact (approximately 100 G: G corresponds to a gravitational acceleration) is applied upon closing the door. Thus, an improvement of impact resistance has been a key issue for the antenna for the vehicle door.

SUMMARY OF THE INVENTION

It is an object of the present invention to provide an antenna that has high bendability and impact resistance, and provide a method for such an antenna.

According to the first aspect of the invention, an antenna is comprised of a core portion laminated by a plurality of magnetic ribbons through a deformable member and a coil portion wound around the core portion.

According to the second aspect of the invention, the deformable member is an air layer.

According to the third aspect of the invention, the deformable member is a cushion member.

According to the fourth aspect of the invention, the deformable member is a rubber-like member.

According to the fifth aspect of the invention, the plurality of the magnetic ribbons are made of either amorphous metal or nanocrystalline magnetism.

According to the sixth aspect of the invention, the amorphous metal is either an iron system or a cobalt system.

According to the seventh aspect of the invention, each surface of the magnetic ribbons is coated by one of a film of a phosphoric acid system, either an organic or inorganic film, or a film coated with ferrite.

According to the eighth aspect of the invention, a manufacturing method for an antenna having a core portion includes a laminating process for laminating a magnetic ribbon and a bonding process for forming a core portion by bonding a peripheral portion of the magnetic ribbon to a connecting resin portion by resin.

According to the ninth aspect of the invention, the manufacturing method for the antenna also includes a forming process for forming a coil portion by winding a conducive coil around a peripheral portion of the core portion with insulated manner, and a resin molding process for forming a resin-molded portion by Injecting a potting material or a hot melt material into a mold after setting the core portion and the coil portion within the mold.

According to the tenth aspect of the invention, a side door handle for a vehicle is comprised of a main body of a door handle, a connecting portion for connecting the main body of the door handle to a side door of the vehicle, and an antenna incorporated within the main body of the door handle. Furthermore, the antenna has a core portion laminated by a plurality of magnetic ribbons through a deformable member and a coil portion wound around the core portion.

BRIEF DESCRIPTION OF THE DRAWINGS

The foregoing and additional features and characteristics of the present invention will become more apparent from the following detained description presumed with reference to the accompanying drawings in which like reference numerals designate like elements:

FIG. 3(*a*) is a longitudinal section of the core portion, and FIG. 3(*b*) is a lateral section of the core portion;

FIG. 4(*a*) is a longitudinal section of the core portion, and FIG. 4(*b*) is a lateral section of the core portion;

FIG. 7(*a*) is a drawing before deformation, and FIG. 7(*b*) is a drawing after deformation.

DETAILED DESCRIPTION OF THE INVENTION

As a result of research by. Inventors of the present invention to provide an antenna that has high impact resistance, the inventors came up with a structure that can absorb bending stress or impact by moving adjacent magnetic ribbons freely when a load is applied to the laminated magnetic ribbons.

Figure 1:
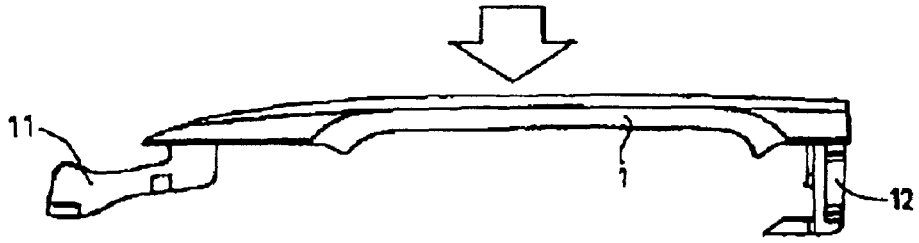
FIG. 1 is a side view of a door handle of a side door for a vehicle in which an antenna according to embodiments of the present invention is incorporated.

Embodiments of the present invention will be described with reference to the drawings. FIG. 1 is a side view of a door handle of a side door for a vehicle in which an antenna according to the embodiments of the invention is incorporated. The door handle of the side door for the vehicle is comprised of a main body 1 of the door handle, and connecting portions 11 and 12 for connecting the main body 1 of the door handle to the side door (not shown). The main body 1 of the door handle and the connecting portions 11 and 12 are made of resin.

Figure 2:
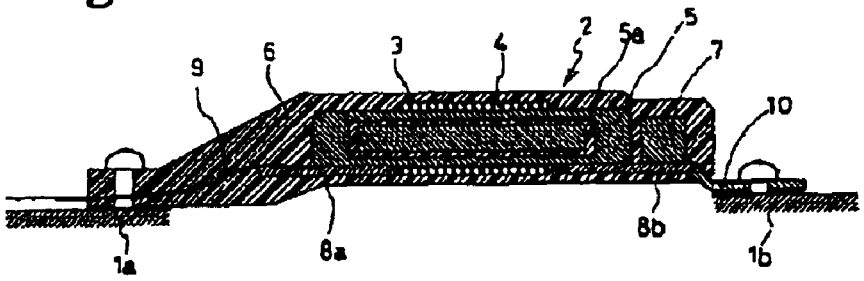
FIG. 2 is an explanatory view according to the embodiments of the invention.

FIG. 2 is an explanatory view of the antenna according to the embodiments of the invention. An antenna 2 is incorporated within the main body 1 of the door handle, and the antenna 2 is connected to the main body 1 of the door handle by both ends of the antenna 2 extended to attachment members 1*a* and 1*b* placed within the main body 1 of the door handle. The antenna 2 is comprised of a core portion 3, a coil portion 4, bobbin portion 5, a resin-molded portion 6, a condenser 7, terminal electrodes 8*a* and 8*b*, and a wire harness 9 etc. The bobbin portion 5 is made of ABS resin and is approximately rectangular-shaped. Furthermore, the bobbin portion 5 has a gap portion 5*a* which has a rectangular shape in its cross section and extended from one end to the other end of the bobbin portion 5 at a center of the bobbin portion 5. The core portion 3 is inserted into the gap portion 5*a* with its longitudinal direction in a right and left direction in FIG. 2, and its laminated direction in a vertical direction in FIG. 2.

The coil portion 4 is formed by an insulated coating conductive coil made from a conductive wire of a wire diameter of 0.28 mm wound around an outer periphery of the bobbin portion 5 in a regular winding. A shape of a cross section of the coil portion 4 is approximately a rectangular. A width of the coil portion 4 is 5.5 mm, and its height varies in accordance with a shape of the core portion 3. Terminal electrodes 8*a* and 8*b* are placed in a longitudinal direction of the bobbin portion 5, and each electrode 8*a* and 8*b* is electrically connected to both ends of the conductive coil of the coil portion 4. Furthermore, one electrode 8*a* is connected to a wire harness 9, and the other electrode 8*b* is connected to one terminal of the condenser 7. The other terminal of the condenser 7 is connected to another wire harness (not shown) placed serially with the wire harness 9.

After inserting the core portion 3, the coil portion 4, the bobbin portion 5, the condenser 7, the terminal electrodes 8*a* and 8*b*, and the wire harness 9 into a mold, a potting material or a hot melt material is injected into the mold. When the material is hardened by heat, the material is removed from the mold, and the resin-molded portion is formed. Since the portions comprising the antenna 2 are molded by the potting material or the hot melt material which has high flexibility, the antenna 2 secures a high impact resistance. Furthermore, since a portion between the core portion 3 and the coil portion 4 is also molded by the highly flexible potting material or hot melt material, the core portion 3 is hardly affected by temperature, humidity, and impact, improving a reliability of the antenna 2.

The wire harness 9 is extended to outside from the resin-molded portion 6 and connected to a control portion (not shown) of the antenna 2. One end of the resin-molded portion 6 (a wire harness side) is connected to the attachment member 1*a* placed inside of the main body 1 of the door handle. An attachment member 10 is placed at the other end of the resin-molded portion 6, and the attachment member 10 is connected to the attachment member 1*b* placed inside the main body 1 of the door handle.

Figure 3:
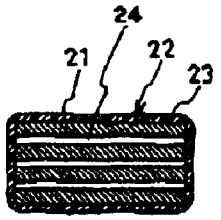
FIG. 3 is a cross sectional view of a core portion of the first embodiment of the invention.
Figure 3:
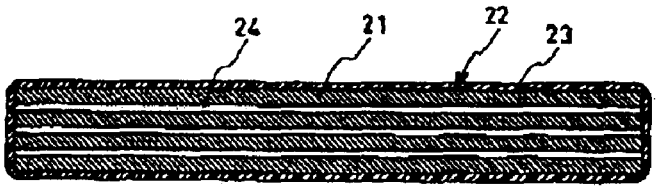

FIG. 3 is a cross sectional view of a core portion of the first embodiment. FIG. 3(*a*) is a longitudinal section of the core portion, and FIG. 4(*b*) is a lateral section of the core portion. A laminated magnetic ribbon portion 22 is formed by a plurality of magnetic ribbons 21 being laminated. The plurality of the magnetic ribbons 21 are connected one another by a connecting resin portion 23 placed at a periphery of the laminated magnetic ribbon portion 22. Spaces between surfaces of the magnetic ribbons 21 facing one another are not bond to each other, and air layers 24 are formed between these surfaces. In the first embodiment of the invention, the air layers 24 correspond to deformable members. The air layers 24 may be very thin, and the magnetic ribbons 21 may be in contact with one another.

Figure 4:
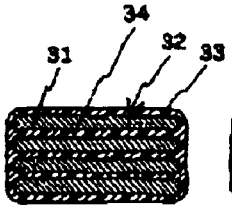
FIG. 4 is a cross sectional view of a core portion of the second embodiment of the invention.
Figure 4:
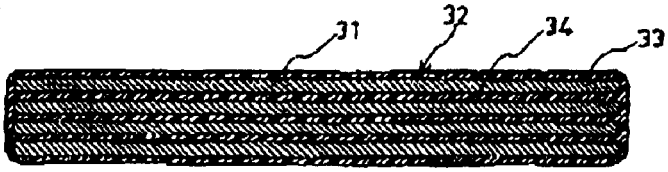

FIG. 4 is a cross sectional view of the core portion of the second embodiment. FIG. 4(*a*) is a longitudinal section of the core portion, and FIG. 4(*b*) is a lateral section of the core portion. A laminated magnetic ribbon portion 32 is formed by a plurality of magnetic ribbons 31 being laminated. Rubber-like members 34 are placed between the magnetic ribbons 31, and surfaces of the magnetic ribbons 31 facing the other surfaces of the magnetic ribbons 31 are bond to one another by the rubber-like members 34. In the second embodiment, the laminated magnetic ribbon portions 32 are surrounded by an enclosing member 33 which is made of the same material as the rubber members 34.

Both of the core portions of the first and second embodiments are used as shown in FIG. 1 and FIG. 2. Ferromagnetic ribbons are used for the magnetic ribbons 21 and 31 of the first and the second embodiments. Among the ferromagnetic ribbons, it is preferred to use the ones that are made of amorphous metal or nanocrystalline magnetism since these materials have a high frequency characteristic and a soft magnetic characteristic. Thus, with these materials, high performance and downsizing of the antenna can be achieved. Also, as for the amorphous metal, it is preferred to use amorphous metal of an iron system or a cobalt system which has high permeability. Although there is no limitation on thickness of the magnetic ribbons 21 and 31, it is preferred to use the magnetic ribbons with thickness equal to or lower than 100 $\mu$m for a high frequency band and reduction of eddy current loss.

Although the magnetic ribbons 21 can be used as they are, it is preferred to use the magnetic ribbons covered by an organic or inorganic film, a film of phosphoric acid system formed by phosphating, or a film coated with ferrite since they can reduce the eddy current loss by forming a film with high electric resistance between ribbons.

Although the drawings of the first embodiment and the second embodiment show four magnetic ribbons 21 and 31 laminated, other magnetic ribbons laminated are abbreviated to clarify a structure of the magnetic ribbon portion, and many magnetic ribbons are laminated in the embodiments.

The embodiments of the present invention and comparative examples will be described.

Embodiment 1

Figure 5:
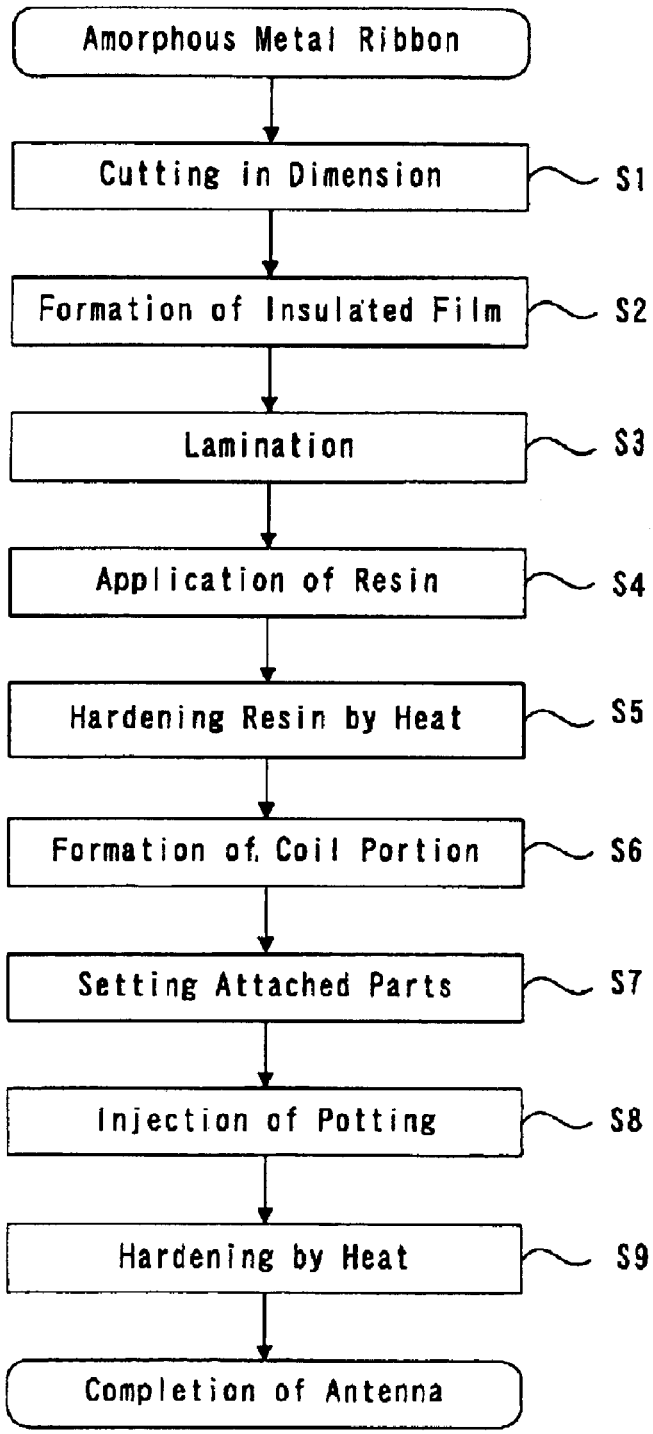
FIG. 5 is a flow chart of manufacturing an antenna according to the first embodiment of the invention.

FIG. 5 is a flow chart showing manufacturing process of an antenna according to the first embodiment. A structure of the laminated magnetic ribbon portion manufactured in the first embodiment is the structure of the core portion shown in FIG. 3. Amorphous metal FT-3 (Fe 73.5%, Cu 1.0%, Nb 3.0%, Si 13.5%, B 9.0%) manufactured by Hitachi Metals Ltd. with 20 $\mu$m of thickness and cut in 5 mm in width and 60 mm in length was used (step S1). The magnetic ribbons are treated in an atmosphere of 550° C. for one hour, and an insulated film is formed on a surface of the magnetic ribbons (step S2).

Next, a laminated magnetic ribbon portion is formed by laminating thirty magnetic ribbons (step S3) (a laminating process). The laminated ribbons are inserted into a mold, and after the laminated ribbons are fixed temporarily by jigs, epoxy resin (SR-30 and H-325 (two-packaged) manufactured by Sanyu Rec Corporation) was applied to only a periphery of the laminated magnetic ribbon portion (step S4). Subsequently, the laminated ribbons together with the mold are inserted into a thermostatic chamber for two hours to be hardened by heat, and the core portion is completed (step S5) (a bonding process). A dimension of the core portion was 5.2 mm in width and 1.0 mm in height.

Impact resistance of the core portion manufactured by the above method was evaluated. First, the magnetic ribbons are placed in a horizontal position, and a longitudinal direction of the core portion is set on a bottom jig with 30 mm of a span for a three-point bending test. A load with speed of 5 mm/min is applied to a central portion of the span by the bottom jig for the three-point bending test until a central portion of the core portion is displaced for 2 mm. After measuring a relation between the load and the displacement, the load is removed from the core portion. Subsequently, the displacement of the central portion of the core portion is measured, and if the displacement of the core portion is returned to zero, the core portion is defined as "no residual strain." On the other hand, if the displacement of the core portion is not returned to zero, the core portion was defined as "residual strain occurred." As for a magnetic characteristic, an impedance analyzer was used for measuring effective permeability $\mu e$ and an effective value Qe of effective Q.

After inserting the manufactured core portion 2 into the gap portion 5*a* of the bobbin portion 5, the conductive coil is wound for thirty turns by a regular winding serially to form the coil portion 4 (step S6) (a process of forming the coil portion). The terminal electrodes 8*a* and 8*b* are installed to the bobbin portion 5 in advance, and the terminal electrodes 8*a* and 8*b* are connected to each end of the conductive coil. Then, the terminal electrode 8*a* is connected to the wire harness 9, the terminal electrode 8*b* is connected to the condenser 7, and the condenser 7 is connected to the wire harness (not shown) respectively (step S7) (a process of setting attached parts). After setting the core portion 3, the coil portion 4, the bobbin portion 5, the condenser 7, the terminal electrode 8, and the wire harness 9 within the mold, an urethane potting material (MV-115: manufactured by Nippon Pelnox Corporation) is injected into the mold (step S8), and the antenna 2 is inserted Into the thermostatic chamber to be hardened for two hours in 80° C. in temperature to form the resin molding portion 6 (step S9) (a resin molding process).

Embodiment 2

An antenna according to the second embodiment is manufactured in the same process as that of the first embodiment except that the urethane potting material (MV-115: manufactured by Nippon Pelnox Corporation) was used instead of the epoxy resin as an adhesive for bonding only the periphery of the laminated magnetic ribbons. However, conditions for hardening the adhesive were changed to two hours and 80° C. in temperature. A dimension of the longitudinal section of the core portion was 5.2 mm in width and 0.7 mm in height. An evaluation method for the embodiment 2 is the same as that of the embodiment 1.

Embodiment 3

Figure 6:
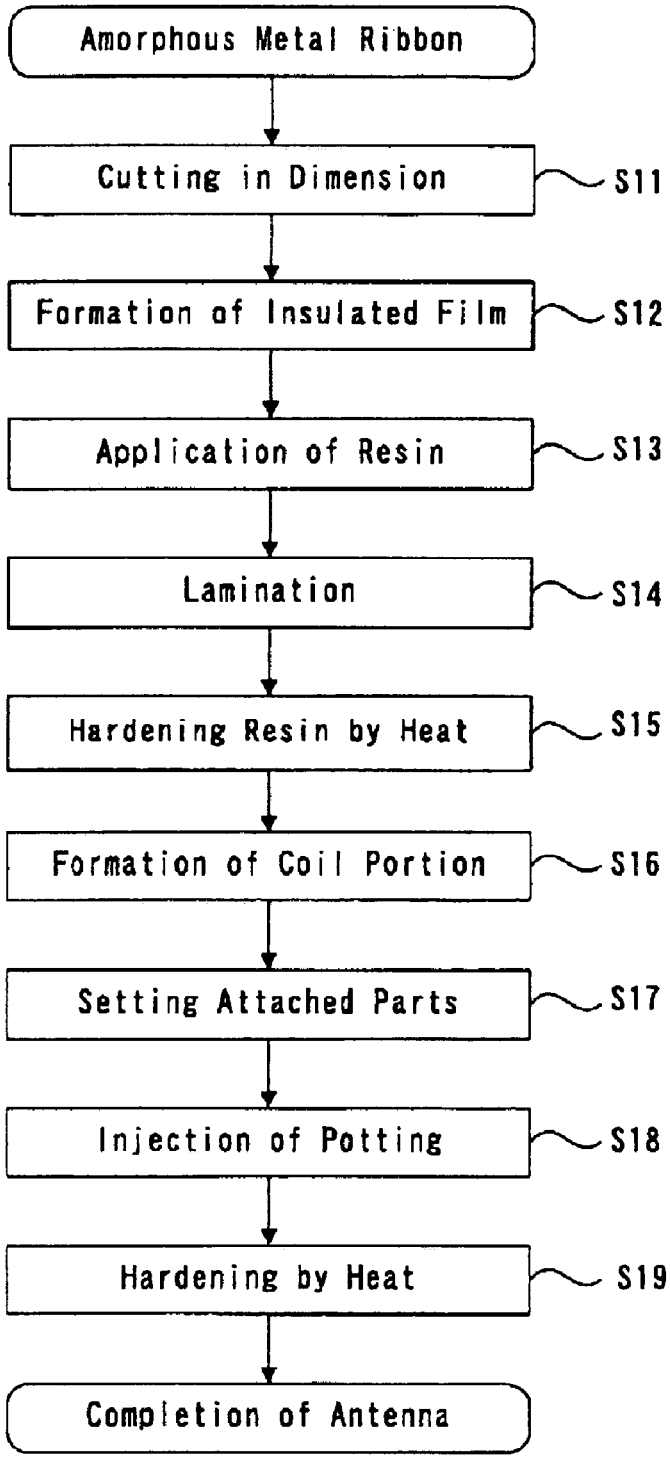
FIG. 6 is a flow chart of manufacturing an antenna according to the third embodiment of the Invention.

FIG. 6 is a flow chart showing a manufacturing process of an antenna according to the third embodiment. A structure of a magnetic ribbon portion manufactured in the third embodiment is the same as that of the second embodiment. The same magnetic ribbons as the first and the second embodiments were used, and the manufacturing process is the same as the first embodiment until step S12. After the step S12, the same urethane potting material as the second embodiment was applied (step S13), and thirty magnetic ribbons are laminated using the same mold as the first embodiment (step S14). Subsequently, the magnetic ribbons are thrown into the thermostatic chamber for two hours with 80° C. in temperature, and the core portion is completed (step S15). A dimension of the longitudinal section of the core portion was 5.2 mm in width and 0.8 mm in height. An antenna of the third embodiment was manufactured in the same process as the first embodiment from a step S16 to the final step. An evaluation method for the embodiment 3 is the same as that of the embodiment 1.

COMPARATIVE EXAMPLE 1

An antenna of the comparative example 1 was manufactured in the same process as the third embodiment except that the epoxy resin applied in the first embodiment was used instead of the urethane potting material. The conditions for hardening the adhesive are the same as those of the first embodiment. A dimension of the longitudinal section of the core portion was 5.2 mm in width and 0.8 mm in height. An evaluation method for the comparative example 1 is the same as that of the embodiment 1.

COMPARATIVE EXAMPLE 2

One-piece sintered ferrite (PC40: manufactured by TDK Corporation) cut in 60 mm in length, 5.2 mm in width, and 2.3 mm in height was used for manufacturing a core portion of the comparative example 2. Subsequently, the same process as the step 6 and the rest of the steps of the embodiment 1 was applied. An evaluation method for the comparative example 2 is the same as that of the embodiment 1.

Evaluation Result

Chart 1 shows evaluation results of the embodiments and the comparative examples. The core portions of the embodiment 1 through 3 and the comparative example 2 are not ruptured by the displacement of 2 mm. "2.00" written in "Displacement" indicates that the core portion was not ruptured. "Load at Peak" indicates a load upon displacing 2 mm, and "Bending Stress at Peak" indicates a maximum stress upon displacing 2 mm. The magnetic characteristics of the embodiment 1 through 3 and the comparative example 2 were approximately the same.

CHART 1

| | Impact Resistance | | | | Magnetic Characteristics | |
|---|---|---|---|---|---|---|
| | Load at Peak (kgf) | Bending Stress at Peak (kgf/mm2) | Displacement (mm) | Residual strain | $\mu e$ | Qe |
| Embodiment 1 | 7.0 and Up | 1.35 | 2.00 | No Residual Strain | 30 | 16 |
| Embodiment 2 | 0.1 and Up | 0.01 | 2.00 | No Residual Strain | 31 | 15 |
| Embodiment 3 | 0.1 and Up | 0.03 | 2.00 | No Residual Strain | 32 | 15 |
| Comparative Example 1 | 3.4 and Up | 0.81 | 2.00 | Residual Strain Occurred | 30 | 17 |
| Comparative Example 2 | 8.1 Ruptured | 0.67 | 0.19 | Ruptured | 25 | 125 |

Although there was no residual strain occurred in the embodiment 1 through 3, the residual strain has occurred in the comparative example 1. With regard to the embodiments, 2 mm is displaced approximately without any stress in the embodiment 2 and 3. This shows that they have high bendability. Particularly, in the case of the embodiment 2 and 3, the residual strain was not detected even after displacing 5 mm.

Figure 7:
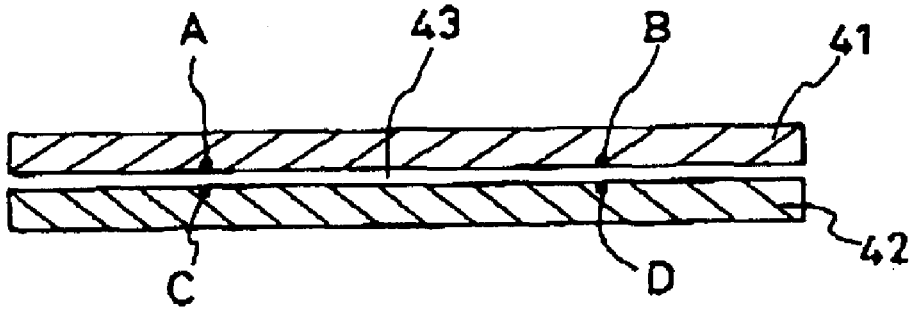
FIG. 7 is an explanatory cross sectional view explaining a function and effect of the antenna according to embodiments of the invention.
Figure 7:
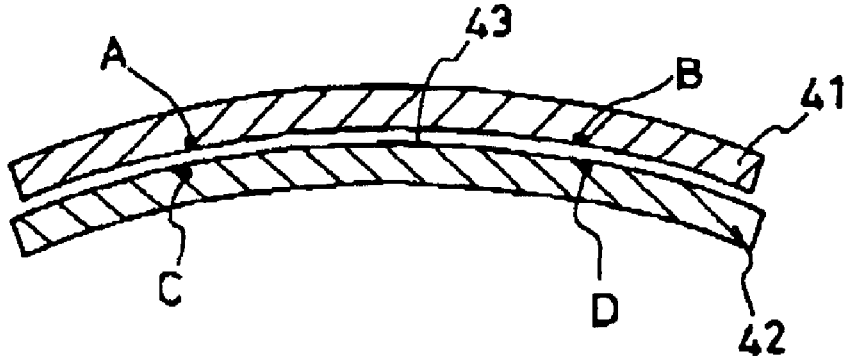

FIG. 7 is an explanatory cross sectional view of the embodiments according to the invention to describe functions and effects of the invention. FIG. 7(*a*) is a drawing before deformation, and FIG. 7(*b*) is a drawing after the deformation. Two magnetic ribbons are shown in these drawings. There is an intermediate layer 43 between a magnetic ribbon 41 and a magnetic ribbon 42. The intermediate layers 43 of the embodiment 1 and the embodiment 2 are the air layers, the intermediate layer 43 of the embodiment 3 is a laminate of the urethane potting material, and the intermediate layer 43 of the comparative example 1 is a laminate of the epoxy resin respectively.

Point A and point C indicate positions of the surfaces of the magnetic ribbon 41 and the magnetic ribbon 42 facing one another before the deformation. Similarly, point B and point D also indicate positions of the surfaces of the magnetic ribbon 41 and the magnetic ribbon 42 facing one another before the deformation. As shown in FIG. 7(*b*), when the core portion is deformed by the impact, a distance between point A and point B on the surface of the magnetic ribbon 42 becomes shorter. On the other hand, a distance between point C and point D on the surface of the magnetic ribbon 42 becomes longer as the core portion is deformed. As a result, the positions of point A, point B, point C, and point D are deviated from their original positions as the core portion is deformed.

Modulus of elasticity of the epoxy resin is large, and a maximum displacement in an elastic limit is small. Thus, as shown in the comparative example 1, when the epoxy resin is used for the intermediate layer 43, the elastic limit of the epoxy resin is partially surpassed because of changes in a distance between point A and point C and a distance between point B, and point D. As a result of these changes in the distances, it is presumed that the residual strain has occurred in the comparative example 1.

On the other hand, as for the embodiments 1 and 2, the magnetic ribbon 41 and the magnetic ribbon 42 are not bond since the air layer is formed between them. Therefore, point A and point C, and point B and point D are free with one another, and thus the magnetic ribbon 41 and the magnetic ribbon 42 are returned to their original positions after the load is removed. Consequently, it is presumed that the residual strain can be prevented unless the magnetic ribbons themselves surpass their elastic limits.

A load at peak of the embodiment 1 is large, yet that of the embodiment 2 is small. As will be described later, this difference in the load at peak is presumed as a difference in materials used for the connecting resin portion 23 placed at the periphery of the laminated magnetic ribbon portion 22. More specifically, since the epoxy resin which has a large modulus of elasticity is used as a material for the connecting resin portion 23 in the embodiment 1, a large load is applied to the core portion of the embodiment 1 by the connecting resin portion 23. On the other hand, in the embodiment 2, the urethane potting material which has a small modulus of elasticity is used, and thus a small load is applied to the core portion of the embodiment 2. Consequently, the bendability and the impact resistance can be higher when the urethane potting material which has a small modulus of elasticity is used.

In the embodiment 1 and 2, the entire periphery of the laminated magnetic ribbon portion 22 is covered by the connecting resin portion 23. However, the connecting resin portion 23 may be placed only at a periphery of the magnetic ribbon 21. Also, the air layer between the adjacent magnetic ribbons may be so thin that the surfaces of the adjacent magnetic ribbons 21 are in contact with one another, The material of the intermediate layer 43 of the embodiment 3 is the urethane potting material. The urethane potting material has a rubber-like elasticity after being hardened. The modulus of elasticity of the urethane potting material is small, and its maximum displacement without residual strain within the elastic limit is large. Therefore, even if the distances between point A and point C, and point B and point D become longer, the displacement is within the elastic limit without high resistance. As a result, the residual strain was not occurred in the embodiment 3.

As described above, a wide range of the deformation can be obtained by placing the deformable member, in other words, the material with small displacement of the elastic limit or the material with the small modulus of elasticity between the laminated magnetic films. As a result, the antenna with high bendability and impact resistance can be achieved. In the embodiments, the air layer or the urethane potting material (a rubber-like member) is used for the deformable member. However, the intermediate layer is not limited to these types, and other gas laminates or rubber-like materials such as a rubber of silicon system (a potting material), or a rubber of an epoxy system (the potting material) may be used.

The deformable members placed between the laminated magnetic ribbons also have a function as cushion members for absorbing impact. Since impact applied to the core portion is absorbed by the cushion members placed between the magnetic ribbons, the impact resistance of the antenna can be achieved.

Although the urethane potting material is used for the material of the resin-molded portion in the embodiments, it may be any material that can mold and fix the core portion and the coil portion. However, it is preferred to use potting materials such as the urethane potting material, a rubber potting material of a silicon system, a rubber potting material of the epoxy system, or hot melt materials such as polyamide resin or urethane resin for the material of the resin-molded portion. These materials have high flexibility and impact resistance and are filled between the coil portion and the core portion without space, and thus the core portion is hardly affected by temperature, humidity, or impact. Therefore, these materials can improve a reliability of the antenna.

Although the amorphous metal is used for the material of the magnetic ribbons in the embodiments, the material is not limited to the amorphous metal, and any material that has high magnetism such as a silicon steel plate or nanocrystalline can be used. However, the amorphous metal has high permeability and elasticity, and high corrosion resistance and the nanocrystalline has high permeability, high frequency characteristic, and high corrosion resistance.

In the case of the comparative example 2, the core portion is ruptured by the displacement of 0.19 mm. Although a large Qe can be obtained and an electric loss can be reduced in accordance with the comparative example 2, a tolerance range of displacement is small, and bendability and the impact resistance are low.

As described above, the antenna is comprised of the core portion laminated by the magnetic ribbon through the deformable portion, and the coil portion wound around the core portion. Also, a manufacturing method for an antenna including a laminating process for laminating the magnetic ribbon and a bonding process to manufacture the core portion by bonding the periphery of the magnetic ribbon is introduced above.

Therefore, the antenna which has high impact resistance can be achieved.

What is claimed is:

1. An antenna comprising a core portion and a coil portion wound around the core portion, the core portion comprising a plurality of laminated magnetic ribbons and an air layer positioned between two of the magnetic ribbons that are positioned adjacent one another, and an enclosing member surrounding all of the laminated magnetic ribbons, the enclosing member being made of a rubber material.

2. An antenna according to claim 1, wherein the plurality of the magnetic ribbons are made of either amorphous metal or nanocrystalline magnetism.

3. An antenna according to claim 2, wherein the amorphous metal is either an iron system or a cobalt system.

4. An antenna according to claim 2, wherein each surface of the magnetic ribbons is coated by one of a film of a phosphoric acid system, either an organic or inorganic film, or a film coated with ferrite.

5. An antenna according to claim 1, wherein the rubber material is a urethane potting material.

6. The antenna according to claim 1, wherein the plurality of laminated magnetic ribbons connect to the enclosing member without any space therebetween.

7. An antenna comprising a core portion and a coil portion wound around the core portion, the core portion comprising a plurality of laminated magnetic ribbons and a cushion portion positioned between two of the magnetic ribbons that are positioned adjacent one another, and an enclosing member surrounding all of the laminated magnetic ribbons, the enclosing member being made of a rubber material.

8. An antenna according to claim 7, wherein each surface of the magnetic ribbons is coated by one of a film of a phosphoric acid system, either an organic or inorganic film, or a film coated with ferrite.

9. An antenna comprising a core portion and a coil portion wound around the core portion, the core portion comprising a plurality of laminated magnetic ribbons and a rubber-like member positioned between two of the magnetic ribbons that are positioned adjacent one another, and an enclosing member surrounding all of the laminated magnetic ribbons, the enclosing member being made of a rubber material.

10. An antenna according to claim 9, wherein the rubber-like member is a urethane potting material.

11. An antenna according to claim 9, wherein the plurality of the magnetic ribbons are made of either amorphous metal or nanocrystalline magnetism.

12. An antenna according to claim 9, wherein each surface of the magnetic ribbons is coated by one of a film of a phosphoric acid system, either an organic or inorganic film, or a film coated with ferrite.

13. An antenna according to claim 9, wherein the enclosing member surrounding the core portion is made of the same rubber material as the rubber-like member.

14. A manufacturing method for an antenna having a core portion comprising laminating a plurality of magnetic ribbons and forming the core portion by connecting a peripheral portion of the magnetic ribbons to a connecting resin portion, the connecting resin portion being placed at a periphery of the core portion, and the connecting resin portion being comprised of a rubber-like member.

15. A manufacturing method for an antenna according to claim 14, further comprising:

winding a conducive coil around a peripheral portion of the core portion with insulated manner; and injecting a potting material or a hot melt material into a mold after setting the core portion and the coil portion within the mold.

16. An antenna according to claim 14, wherein the rubber-like member is made from a urethane potting material.

17. A side door handle for a vehicle comprising;

a main body of a door handle;

a connecting portion for connecting the main body of the door handle to a side door of the vehicle; and an antenna incorporated within the main body of the door handle, wherein the antenna comprises a core portion and a coil portion wound around the core portion, the core portion comprising a plurality of laminated magnetic ribbons and an air layer positioned between two of the magnetic ribbons that are positioned adjacent one another, and an enclosing member surrounding all of the laminated magnetic ribbons, the enclosing member being made of a rubber material.

18. A side door handle for a vehicle comprising;

a main body of a door handle;

a connecting portion for connecting the main body of the door handle to a side door of the vehicle; and an antenna incorporated within the main body of the door handle, wherein the antenna comprises a core portion and a coil portion wound around the core portion, the core portion comprising a plurality of laminated magnetic ribbons and a cushion member positioned between two of the magnetic ribbons that are positioned adjacent one another, and an enclosing member surrounding all of the laminated magnetic ribbons, the enclosing member being made of a rubber material.

19. A side door handle for a vehicle comprising;

a main body of a door handle;

a connecting portion for connecting the main body of the door handle to a side door of the vehicle; and an antenna incorporated within the main body of the door handle, wherein the antenna comprises a core portion and a coil portion wound around the core portion, the core portion comprising a plurality of laminated magnetic ribbons and a rubber-like member positioned between two of the magnetic ribbons that are positioned adjacent one another, and an enclosing member surrounding all of the laminated magnetic ribbons, the enclosing member being made of a rubber material.

20. A side door handle for a vehicle according to claim 19, wherein the rubber-like member is a urethane potting material.

* * * * *